US006280894B1

(12) United States Patent
Landa et al.

(10) Patent No.: US 6,280,894 B1
(45) Date of Patent: Aug. 28, 2001

(54) IMAGING APPARATUS AND PHOTORECEPTOR THEREFOR

(75) Inventors: Benzion Landa, Nes-Ziona; Yosef Rosen, Moshav-Sitria; Judith Gutfarb, Rehovot; Yaacov Almog, Nes-Ziona, all of (IL)

(73) Assignee: Indigo NV, Maastricht (NL)

( * ) Notice: Subject to any disclaimer, the term of this patent is extended or adjusted under 35 U.S.C. 154(b) by 0 days.

(21) Appl. No.: 09/487,403

(22) Filed: Jan. 26, 2000

Related U.S. Application Data

(62) Division of application No. 09/171,396, filed as application No. PCT/IL97/00127 on Apr. 17, 1997, now Pat. No. 6,120,966.

(30) Foreign Application Priority Data

Apr. 17, 1996 (IL) ..... 117950

(51) Int. Cl.[7] ..... G03G 5/10
(52) U.S. Cl. ..... 430/64; 399/164; 399/117
(58) Field of Search ..... 399/159, 164, 399/117; 430/60, 64

(56) References Cited

U.S. PATENT DOCUMENTS

| | | | | |
|---|---|---|---|---|
| 4,596,754 | | 6/1986 | Tsutsui et al. | 430/49 |
| 5,023,666 | | 6/1991 | Shimazaki et al. | 399/150 |
| 5,119,133 | * | 6/1992 | Swain | 355/212 |
| 5,669,045 | * | 9/1997 | Swain | 399/159 |
| 5,745,829 | | 4/1998 | Gazit et al. | 399/302 |

FOREIGN PATENT DOCUMENTS

| | | |
|---|---|---|
| 39 13 613 A1 | 11/1989 | (DE) . |
| 0 144 201 A2 | 6/1985 | (EP) . |
| 0 156 510 A1 | 10/1985 | (EP) . |
| 53-82351 | 7/1978 | (JP) . |
| 1-185647 | 10/1989 | (JP) . |
| 3-45956 | 2/1991 | (JP) . |
| 4-042232 | 5/1992 | (JP) . |
| 5-006018 | 5/1993 | (JP) . |
| WO 91/17485 A1 | 11/1991 | (WO) . |
| WO 96/07955 | 3/1996 | (WO) . |

* cited by examiner

*Primary Examiner*—John Goodrow
(74) *Attorney, Agent, or Firm*—Fenster & Company Patent Attorneys Ltd.

(57) ABSTRACT

A photoreceptor for mounting on a drum comprising:

a photoreceptor sheet comprising a backing layer, a conductive layer and a photoconductive layer; and an underlayer comprising a layer of cloth.

31 Claims, 6 Drawing Sheets

FIG. 1A
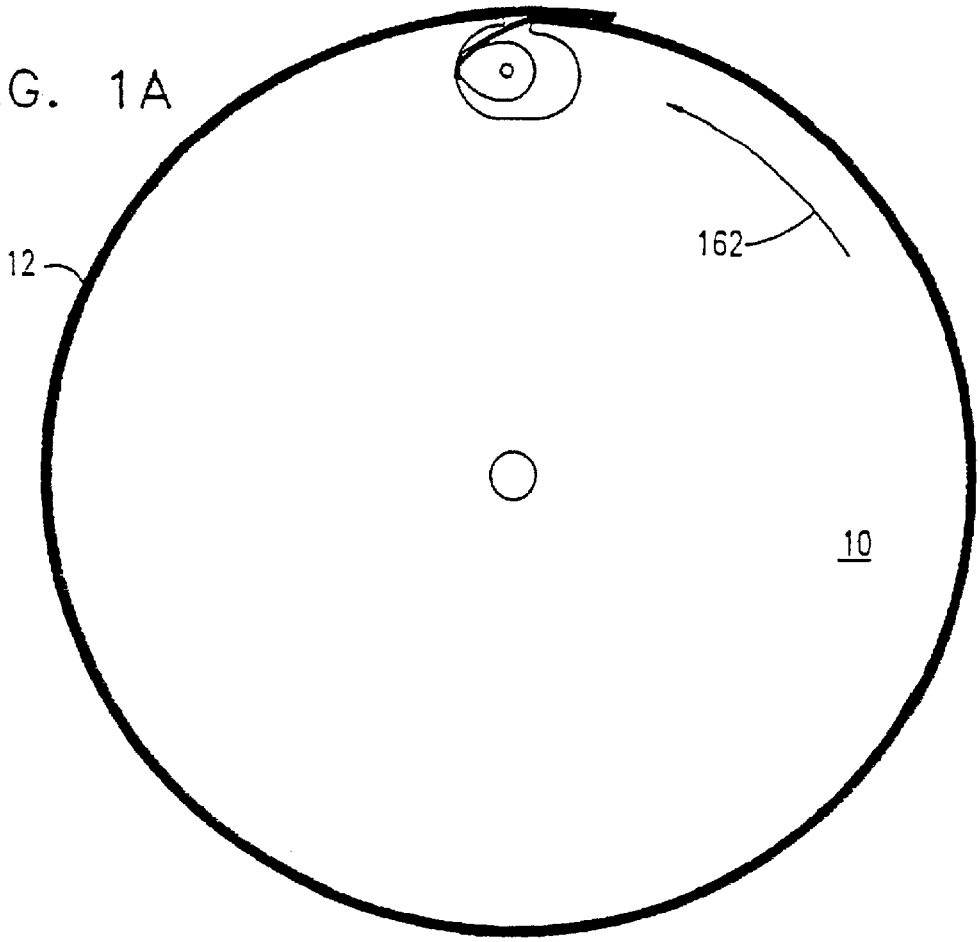
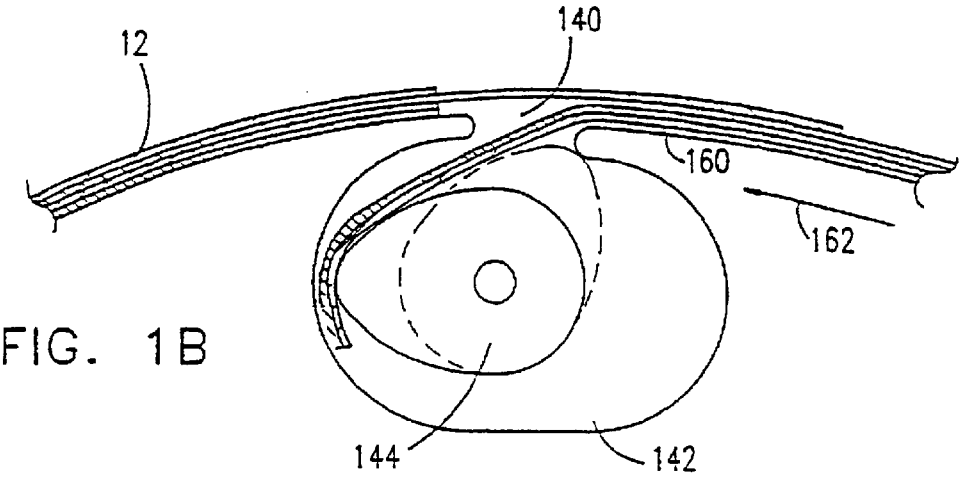
FIG. 1B

200

IMAGING APPARATUS AND PHOTORECEPTOR THEREFOR

RELATED APPLICATIONS

This application is a divisional application of U.S. patent application Ser. No. 09/171,396, filed on May 3, 1999 which is the US national filing of PCT application PCT/IL97/00127, filed Apr. 17 1997, and which entered the national phase on Oct. 16, 1998 now U.S. Pat No. 6,120,966.

FIELD OF THE INVENTION

The present invention relates to image forming and image transfer apparatus especially for use in electrostatic imaging using a sheet type photoreceptor.

BACKGROUND OF THE INVENTION

Organic photoreceptor materials for use in toner imaging are well known. In some systems the organic photoreceptor is coated onto a drum or endless belt on which an electrostatic image is formed. In other systems a sheet of photoreceptor material is mounted onto a drum to provide the same function.

WO 96/07955 published Mar. 14, 1996 and assigned to the same assignees as the present application describes a photoreceptor having an underlying dust masking layer, preferably of paper.

SUMMARY OF THE INVENTION

The present invention seeks to provide, in a first aspect thereof, improved image forming apparatus utilizing a new sheet photoreceptor configuration.

The present invention further seeks to provide, in a second aspect thereof, an improved sheet photoreceptor for use in such apparatus.

There is thus provided, in accordance with a preferred embodiment of the invention, a method of pre-conditioning an organic photoreceptor, comprising:

a) providing an organic photoreceptor having a residue of organic material thereon; and b) applying a solubilizing agent which solubilizes the organic material, preferably together with a solvent, to the photoreceptor surface.

Preferably, the method includes heating the organic photoreceptor by an amount operative to aid in removing the organic material.

Preferably, the method further includes removing the solubilizing agent from the photoreceptor surface.

In a preferred embodiment the agent comprises a surfactant. Preferably the surfactant comprises Polyolifin Amide Alkeneamine and/or Amaco 9040.

In a preferred embodiment of the invention the organic material is a conductive material. Preferably, the organic material is Charge Transport Material. Preferably, the organic material is a surface contaminant.

There is further provided, in accordance with a preferred embodiment of the invention, a photoreceptor system for mounting on a drum comprising:

a photoreceptor sheet comprising a backing layer, a conductive layer and a photoconductive layer; and an underlayer comprising a layer of cloth.

In a preferred embodiment of the invention the layer of cloth is a layer of open weave cloth.

Preferably, the system includes an adhesive layer on the side of the underlayer opposite the cloth layer.

Preferably, the underlayer comprises a resilient layer attached to the cloth layer. Preferably, the resilient layer is a rubber layer. Preferably, the resilient layer has a Shore A hardness of between 20 and 30.

In a preferred embodiment of the invention the resilient layer does not fill the weave in the cloth.

In a preferred embodiment of the invention, the cloth layer comprises a polyester material. Alternatively or additionally, the cloth layer comprises a nylon material.

In a preferred embodiment of the invention, the cloth is formed of thin threads of material taken in groups to produce the weave. Preferably, the threads have a diameter of less than about 5% of the warp repeat of the cloth. Preferably, the repeat of the weave of the cloth is between about 230 micrometers and about 320 micrometers in at least one direction. Preferably, threads used to form the weave fill less than about 70% of the weave in at least one direction.

There is further provided, in accordance with a preferred embodiment of the invention, a photoreceptor system for mounting on a drum comprising:

a photoreceptor sheet comprising a backing layer, a conductive layer and a photoconductive layer; and an underlayer comprising a layer of sponge material.

There is further provided, in accordance with a preferred embodiment of the invention, a method for attaching a photoreceptor system to a drum comprising:

providing a photoreceptor system according to any of the above definitions; and attaching the photoreceptor system to the drum with the underlayer between the photoreceptor and the drum.

In a preferred embodiment of the invention, the underlayer is adhered to the drum.

There is further provided, in accordance with a preferred embodiment of the invention, an underlayer for a photoreceptor comprising a cloth layer.

In a preferred embodiment of the invention the layer of cloth is a layer of open weave cloth.

Preferably, the underlayer includes an adhesive layer on the side of the underlayer opposite the cloth layer.

Preferably, the underlayer comprises a resilient layer attached to the cloth layer. Preferably, the resilient layer is a rubber layer. Preferably, the resilient layer has a Shore A hardness of between 20 and 30.

In a preferred embodiment of the invention the resilient layer does not fill the weave in the cloth.

In a preferred embodiment of the invention, the cloth layer comprises a polyester material. Alternatively or additionally, the cloth layer comprises a nylon material.

In a preferred embodiment of the invention, the cloth is formed of thin threads of material taken in groups to produce the weave. Preferably, the threads have a diameter of less than about 5% of the warp repeat of the cloth. Preferably, the repeat of the weave of the cloth is between about 230 micrometers and about 320 micrometers in at least one direction. Preferably, threads used to form the weave fill less than about 70% of the weave in at least one direction.

There is further provided, in accordance with a preferred embodiment of the invention, an underlayer for a photoreceptor comprising a sponge rubber layer.

BRIEF DESCRIPTION OF THE DRAWINGS

The present invention will be understood and appreciated more fully from the following detailed description, taken in conjunction with the drawings in which:

FIGS. 1A and 1B are cross-sectional, simplified, overall and expanded, partial drawings, respectively of a drum on which a photoreceptor is mounted, showing a preferred mounting method for photoreceptors;

DETAILED DESCRIPTION OF PREFERRED EMBODIMENTS

Figure 1C:
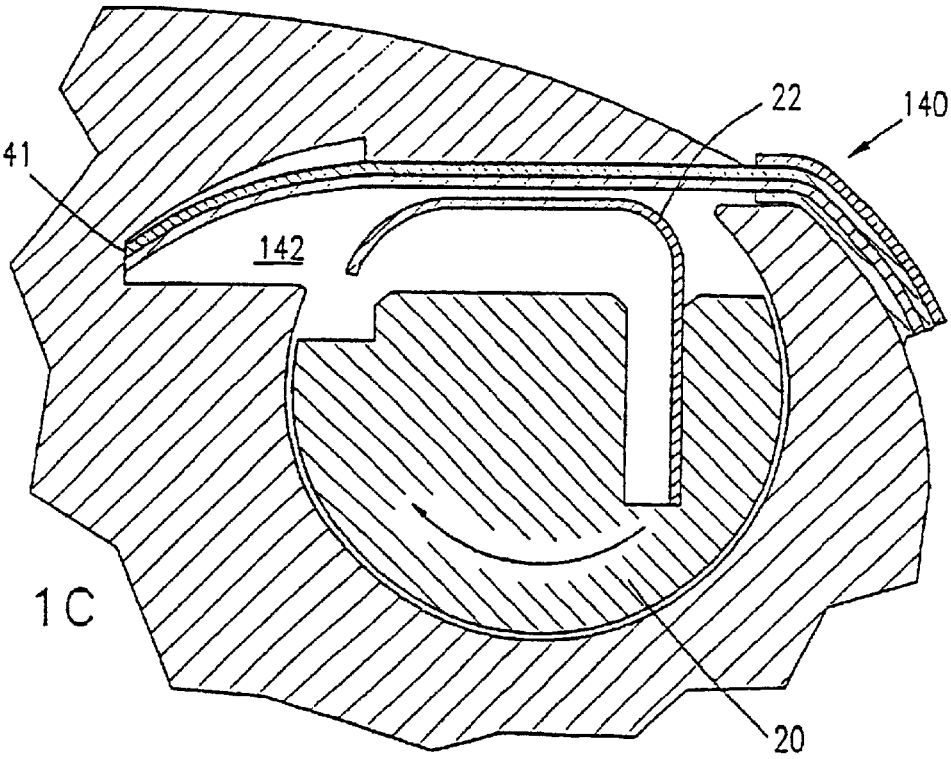
FIGS. 1C and 1D show an alternative method for mounting photoreceptors in respective open and gripping configurations.

A novel photoreceptor sheet 12 and apparatus and a method for mounting the sheet on a drum 10 are shown in FIGS. 1A–1D and 2A–2E.

Photoreceptor sheet 12 is preferably mounted on drum 10 using the mechanisms shown in FIGS. 1A and 1B or FIGS. 1C and 1D. As shown most clearly in FIG. 1B, one end of photoreceptor sheet 12 is inserted into a slot 140 which forms the entryway to a cavity 142 formed in drum 10. An eccentric cylindrical cam 144 which is situated in the cavity can be rotated to one of two positions. With the cam in a first position shown by dotted lines in FIG. 1B, the photoreceptor can be inserted into the slot and between the cam and a wall of cavity 142. After the photoreceptor is in the position shown in FIG. 1B, cam 144 is rotated to the position shown by the solid lines, thereby pressing the cam against the photoreceptor and holding it in position on the drum.

Figure 1D:
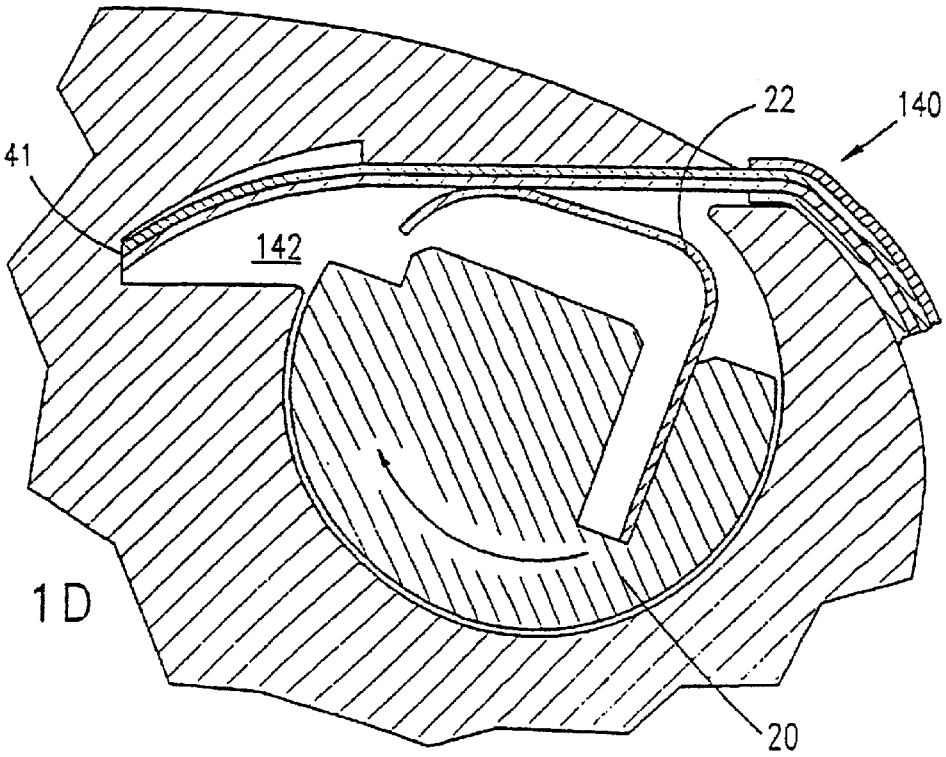

FIGS. 1C and 1D show a rotating member 20 having a resilient element 22, such as a row of spring fingers attached thereto and facing toward the outside of the drum. When the rotating member is in an open position as shown in FIG. 1C, the photoreceptor can be inserted into slot 140 past resilient element 22. Preferably, resilient element 22 guides the inserted end of the photoreceptor to position 141 which acts to assure that the photoreceptor is positioned without skew relative to the rotating direction.

When the rotating element is turned as shown in FIG. 1D the resilient fingers press against the photoreceptor and hold it firmly against the outer wall of cavity 142.

A preferred embodiment of photoreceptor sheet 12 which is especially suitable for mounting in accordance with the method illustrated in FIGS. 1A–1D is shown in FIGS. 2A–2D. Photoreceptor sheet 12 consists essentially of an especially configured photoreceptor and an underlayer preferably a sheet of cloth, preferably an open weave cloth which preferably acts as a dust encasing material. As shown most clearly in FIGS. 2B–2D, a central portion 150 of photoreceptor sheet 12 comprises four layers, a cloth layer 151, which is shown bottom most on FIGS. 2B–2D and is in contact with drum 10, a backing layer 152, such as of Mylar or the like, adjacent to the cloth layer, which may be attached thereto, but is preferably not attached thereto over its entire surface, a conducting layer 154 overlying the backing layer and a photoconductive layer 156 overlying the conducting layer. In general the photoconductive layer comprises a charge transport layer and a charge generation layer; however, these are referred to herein as a "photoconductive layer" for simplicity of the discussion, since the exact construction of the photoconductive layer or layers does not form a part of the present invention. In an especially preferred embodiment of the invention, the cloth layer is not attached to the photoreceptor and is attached to the underlying drum over at least a portion of its surface.

A preferred photoreceptor is, for example, Emerald 2 (manufactured by Lexmark). To improve compatibility of the photoreceptor when it is used with liquid toner, the photoconductor should preferably be treated by one of the treatments specified in PCT publication WO 91/17485 , now U.S. Pat. No. 5,376,491 which corresponds to copending U.S. application Ser. No. 07/946,411, the disclosure of which is incorporated by reference.

In general these applications describe several processes. In one process, the photoreceptor sheet is mounted on a drum with the photoconductive surface facing outwards. The sheet is subjected to heat treatment which removes stress from the photoconductive layer without removing it from the backing layer. The photoreceptor is now cooled, without removing it from the drum.

When the photoreceptor is removed from the drum, the photoconductive layer is in compression and the backing layer is in tension.

In a second process the photoreceptor sheet is subjected to tension and heated to a temperature at which the photoconductive layer is stress released but at which the backing layer is not stress released. The sheet is cooled and then the tension is removed. This process also results in a photoreceptor sheet in which the photoconductive layer is in compression and the backing layer is in tension.

It has also been found that organic photoreceptors may require a pre-conditioning process to assure that the print quality is consistent from the first print after installation of a new photoreceptor. It has been found that when an unconditioned photoreceptor is installed, the prints have a higher contrast than when the photoreceptor stabilizes. This appears to be caused by an increased surface conductivity of the photoreceptor. Thus, when the printer is set for long term characteristics of the photoreceptor, image quality, especially for halftone images, is not optimal and the image quality gradually improves with use. In the past, it was necessary to condition the photoreceptor in the printer itself by subjecting it to many cycles either in "idle" or with images to stabilize the photoreceptor characteristics. The present inventors have found that when a photoreceptor is treated in the following manner, no "idle" or other conditioning is required in the printer:

a) The photoreceptor is preferably heated to about 49° C. However, in certain preferred embodiments of the invention, the range of heating is between 45° C. and 50° C., although under certain circumstances, it may be heated to a greater or lesser effect as described below.

b) Apply a solution of 20% Lubrizol 2153 (Lubrizol Corp., USA) which acts as a solubilizing agent or surfactant for the material on the photoreceptor, in a hydrocarbon solvent such as Isopar L (Exxon), preferably using a sponge or other applicator. The applicator preferably smears the solution across the surface several times. Lubrizol 2153 is marketed as a paint and ink additive and includes Polyolifin Amide Alkenemine as an active ingredient.

c) After waiting about 30 seconds to allow the solution to act on the surface, the photoreceptor is rinsed with a hydrocarbon solvent such as Isopar L (Exxon) and dried.

This process is believed to remove traces of surface contaminant, believed to be excess Charge Transport Material (CTM) from the surface of the photoreceptor. When the photoreceptor is used in a liquid toner process, the carrier liquid in the liquid toner gradually removes the contaminant, changing the characteristics of the photoreceptor. The present treatment avoids this change in characteristics.

The choice of temperature, surfactant and solvent are somewhat interdependent and will depend on the type of contaminant or CTM which is to be removed and the physical properties of the photoreceptor. For example, too high a temperature (in some cases over 50° C.) will cause the solvent solution to attack the surface of the photoreceptor. If the temperature is too low, the CTM will not be fully removed. A lighter solvent, such as Isopar G can also be used, however, light solvents have a tendency to damage the photoreceptor and heavy solvents are hard to evaporate/remove from the photoreceptor. Other suitable surfactants, such as Amoco 9040 may be used in place of the preferred Lubrizol surfactant, however, many surfactants are not suitable for this application.

In a third process, described in the above mentioned PCT application, the surface of the photoconductive layer is chemically treated to remove stress from the layer and make it more plastic or elastic than it previously was. Preferably materials such as cyclohexanone are used to chemically treat the photoconductive layer.

What should be noted in FIGS. 1B–1D is that not all of the layers extend to the ends of photoreceptor sheet 12. In particular, the end of the sheet which is inserted into slot 140 (the "leading edge" of the sheet), as shown in FIGS. 1B–1D, preferably has only two layers, i.e., backing layer 152 and conducting layer 154. This assures that the conducting layer, when pressed against the interior of cavity 140 by cam 144 or member 22, will make good electrical contact with the cavity wall. This provides convenient grounding of the conductive layer, even when the backing layer and the paper layer are not conducting.

Alternatively, the photoreceptor can be provided with a conductive edge which is electrically connected with the conductive layer and either the cavity wall or resilient member 22, or both.

While the disclosed mounting method and exposed layer configuration correspond to the best mode for carrying out the invention, it should be understood that the invention, as claimed, is not limited for use with such photoreceptors and can be used with other types of photoreceptor.

In the prior application WO 96/07955, mentioned above, the underlayer was preferably a paper layer which was preferably attached to the backing layer near the leading edge of the photoreceptor and at the end of the paper, i.e., at reference numeral 158 therein. More preferably, the paper was attached to the photoreceptor over only a portion of the width of the photoreceptor to reduce wrinkles during installation.

The function of the paper layer was to reduce the effect of dust or other particles which may be on drum 10 (or possibly between the photoreceptor and the paper) from affecting the imaging process by causing pressure points on the surface of the photoreceptor. In the present invention, the paper layer is replaced by a cloth layer, more preferably a composite open weave cloth layer as described in detail below.

Figure 2A:
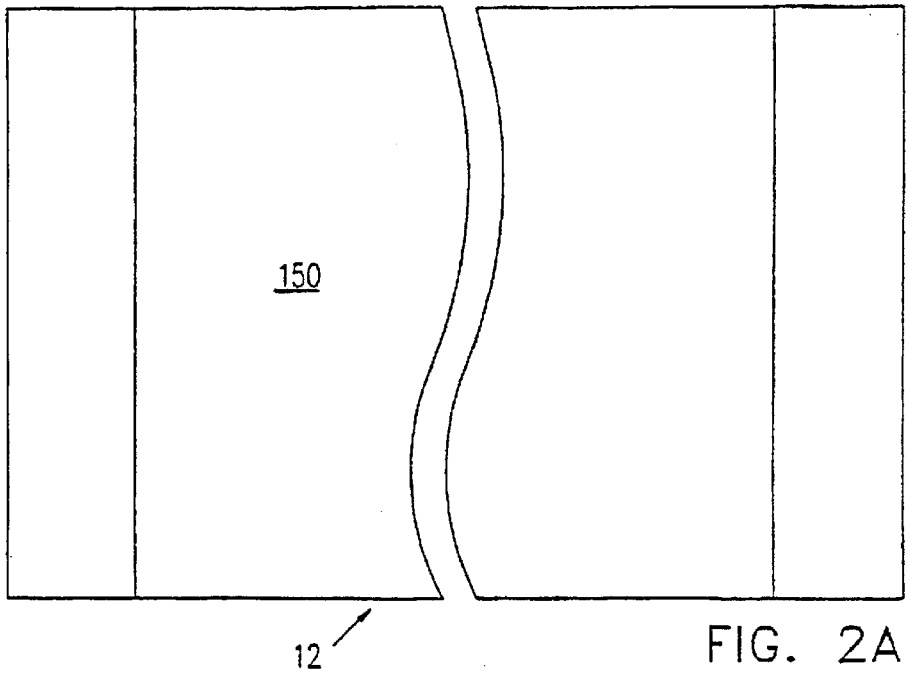
FIGS. 2A and 2B are respective top and side views of a photoreceptor in accordance with a preferred embodiment of the invention.
Figure 2B:
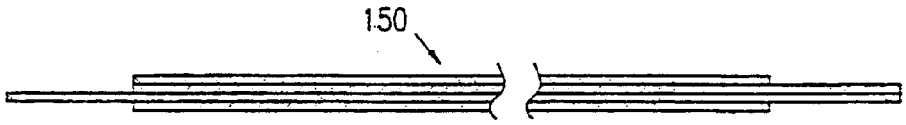
Figure 2C:
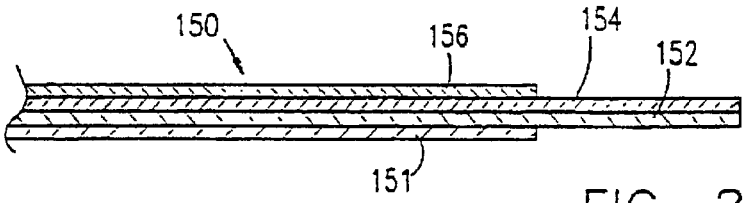
FIGS. 2C and 2D are cross-sectional partial side views of the photoreceptor of FIGS. 2A and 2B.
Figure 2D:
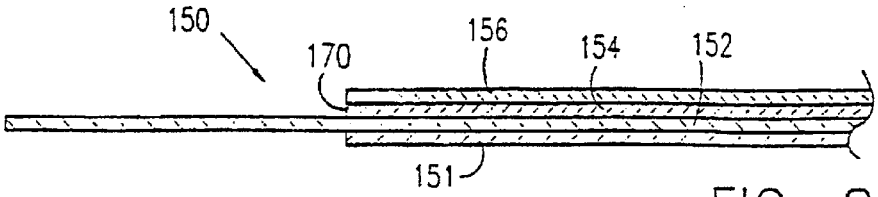

The other end of the photoreceptor (its trailing edge), which is shown in detail in FIG. 2D, preferably comprises only the backing layer, and, as shown in FIGS. 1B–1D, the backing layer extension is long enough to overlay slot 140 so as to avoid liquid toner entering cavity 142. Further, the outer surface of drum 10 is shaped near slot 140 (at reference numeral 160) to provide a slope so that the contact between the photoreceptor and surfaces which it contacts is smooth, i.e., such that the overall diameter of the drum and the photoreceptor and, if present, the overlaying trailing edge, remains independent of the angular position on the drum.

All the layers other than the backing layer are removed at the trailing edge mainly to obviate any chance that the conducting surface will touch a charging device such as a scorotron which is normally present in electrostatic imaging apparatus. Due to the absence of grounded conducting layer 154 at the trailing edge of generally dielectric backing layer 152 remains substantially constantly charged, at the trailing edge, when the photoreceptor sheet is in operative use. This results in electrostatic attraction between drum 10 and the charged trailing edge of sheet 12, assisting in the adherence of sheet 12 to drum 10. It should be noted that sheet 12 is generally not attached to drum 10 by mechanical means, other than at the leading edge, to account for possible variations in the length of sheet 12 during operation. The electrostatic force provided by the dielectric trailing edge of sheet 12 allows circumferential relative motion between sheet 12 and drum 10.

Finally, if the photoreceptor is pressed against another surface, the trailing edge of the photoreceptor is cut at a slight angle to square, of about 1 in 35. This angle is used to provide a smooth transition of contact, at the edge, for a cleaner blade, used to clean untransferred toner from the photoreceptor, prior to the next imaging cycle. A photoreceptor sheet having square cut ends or having one or both edges cut at a slight angle is referred to herein as a "substantially rectangular" photoreceptor sheet. All edges and transitions are preferably smooth without jagged margins.

For clarity, the overlapping end of the photoreceptor sheet is not shown in FIGS. 1C and 1D.

The dimensions of the leading and trailing edges of the photoreceptor can be varied to suit the particular application. The conductive edge (inserted into slot 140) of the photoreceptor is preferably about 13 mm wide and the trailing edge (for overlap) is preferably about 20 mm wide.

For reference, the direction of rotation of drum 10 is shown by an arrow 162.

To avoid possible voltage breakdown, for reasons described in detail below, it is generally desired that the trailing edge of photoconductive layer 156 extend beyond the trailing edge of conductive layer 154 or, at least, that the two edges be substantially aligned, as shown in FIG. 2D.

Figure 2E:
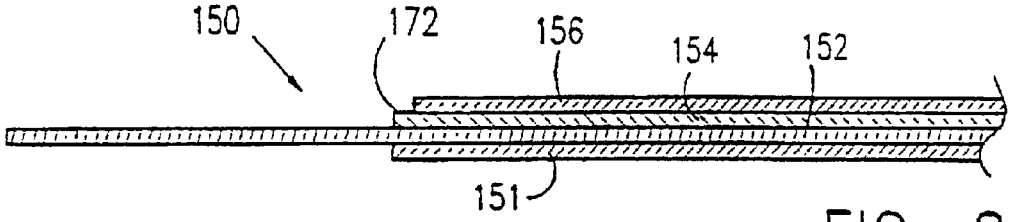
FIG. 2E is a cross-sectional partial side view of a photoreceptor in accordance with another, preferred, embodiment of the present invention.

Unfortunately, these desired arrangements of the trailing edges have been found to be extremely difficult to implement. FIG. 2E illustrates an alternative, more practical, embodiment of the trailing edge of photoreceptor sheet 12 in which conductive layer 154 extends slightly beyond photoreceptor layer 156.

The above described photoreceptor sheet 12 may be used in any known electrostatic imaging device. However, in a preferred embodiment of the present invention, liquid toner imaging apparatus is used, preferably of the type described in U.S. patent application Ser. No. 08/371117, filed Jan. 11, 1995, now U.S. Pat. No. 5,745,829 the disclosure of which is incorporated herein by reference. In such imaging apparatus, an electrically biased squeegee roller (not shown) is used for squeegeeing a layer of liquid toner which is developed onto the photoreceptor surface. The squeegee roller is typically electrically biased, preferably to a negative voltage of 1300–1600 Volts, and urged against the photoreceptor with a predetermined pressure, typically approximately 90 grams per centimeter along the length of the squeegee roller. This provides both electrical and mechanical squeegeeing of the layer of liquid toner on the photoreceptor.

It has been found that the large difference in electric potential between the squeegee roller and conductive layer 154 of sheet 12, which is typically grounded as described above, may result in electrical breakdown at the trailing edge of layer 154. This breakdown of voltage may occur during actual contact between the squeegee roller and the trailing edge of layer 154 or by arcing between the squeegee roller and the conductive layer. Actual contact between the edge of layer 154 and the squeegee roller is possible, particularly in the embodiment of FIG. 2E, due to slight compliance of the generally resilient sheet 12 when urged by the generally rigid squeegee roller.

It is appreciated that the above described breakdown results in gradual, accumulative, deterioration of both photoreceptor surface 12 and the squeegee roller. Consequently, the cumulative damage to the squeegee roller results in degraded performance of the imaging apparatus due to less effective and inhomogeneous squeegeeing of the liquid toner on the photoreceptor surface. Thus, in a preferred embodiment of the present invention, the trailing edge of layer 154 is insulated to prevent breakdown, as described in detail below. It should be noted that insulation of the trailing edge of layer 154 is preferred also in the desired, yet not readily implemented, arrangement (not shown in the drawings) in which the trailing edge of layer 156 extends beyond the trailing edge of layer 154.

Figure 3A:
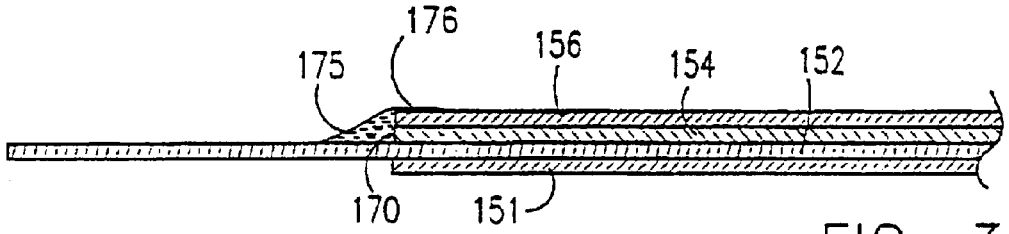
FIGS. 3A and 3B are cross-sectional partial side views of two, respective, types of insulated-edge photoreceptors.
Figure 3B:
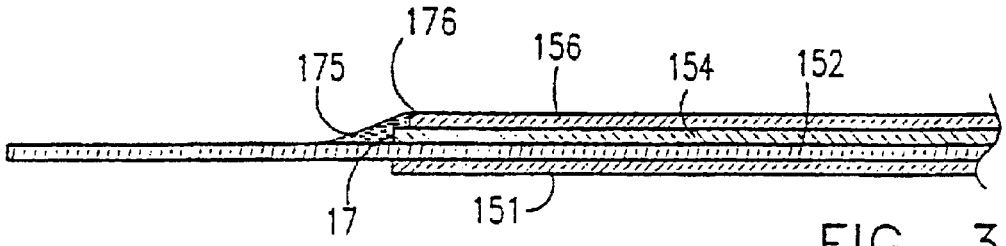

FIGS. 3A and 3B which schematically illustrate two types of trailing edges, analogous to the two types of trailing edges shown in FIGS. 2D and 2E, respectively, whose conductive layers 154 are electrically insulated at edges 170 and 172, respectively, in accordance with a preferred embodiment of the present invention. According to this preferred embodiment, a layer 175 of, preferably dielectric, insulating material is applied to trailing edge 170 (FIG. 3A) or trailing edge 172 (FIG. 3B), preventing electrical breakdown thereat. To ensure complete coverage of edge 170 or edge 172, layer 175 preferably extends slightly beyond edges 170 or 172, both on photoreceptor layer 156 and on backing layer 152. The extension of layer 175 on layer 156 is indicated by reference numeral 176. For imaging systems using a scraper, such as a doctor blade, extension 176 is preferably made extremely thin to avoid damage to the scraper. This is because the scrapers used by such imaging systems are generally extremely sensitive to protrusions in the direction of scraping.

In a preferred embodiment of the invention, insulating layer 175 is formed of HumiSeal type 1A24, a vinyl-modified-epoxy based dielectric material, available from Columbia Chase Corporation, New York, USA. This insulating material is provided in a solids concentration of 20–24 percent by weight and a viscosity of 100–130 centipoise and has a drying/handling time of 15 minutes and a recommended curing time of 24 hours at room temperature. The material can be thinned, for example using acetone, to adjust the viscosity of the material for a given method of application. The cured layer is generally transparent, highly adhesive, very flexible and very durable at varying temperature and humidity conditions. The cured layer has a dielectric withstand voltage of approximately 3,900 volts, a dielectric constant of approximately 2.88 at 1 MHz and 25 degrees centigrade, a dissipation factor of 0.002, an insulation resistance of approximately 350,000,000 Megohms and a moisture resistance of approximately 30,000 Megohms. The material is also highly resistant to solvents and various chemicals used in liquid toner imaging processes.

Although the use of HumiSeal type 1A24 is preferred, layer 175 may be formed of any other suitable dielectric material. For example, layer 175 may be formed of HumiSeal type 1A33 , a polyurethane based dielectric material, or the layer may be formed of a material based on polyvinyl alcohol (88% hydrolyzed), as described in copending U.S. patent application Ser. No. 08/371117, filed Jan. 11, 1995, the disclosure of which is incorporated herein by reference.

Figure 4A:
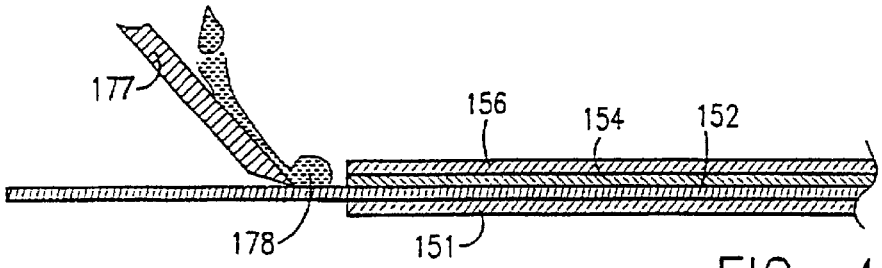
FIGS. 4A, 4B, and 4C are respective side view, top view, and side view illustrations of three respective steps in a preferred method of forming the insulated edge photoreceptor of FIG. 3A.
Figure 4B:
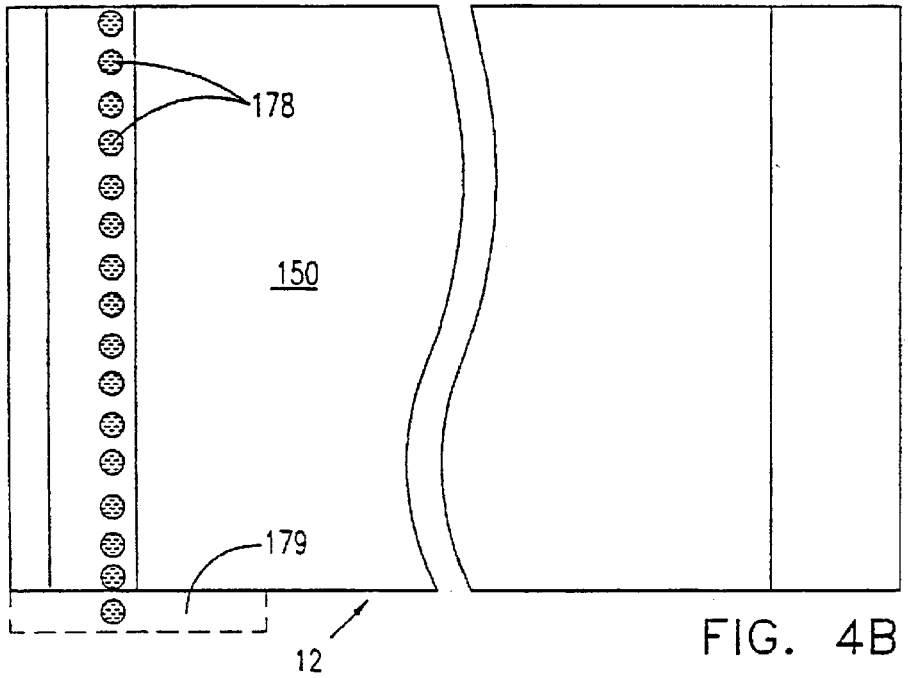
Figure 4C:
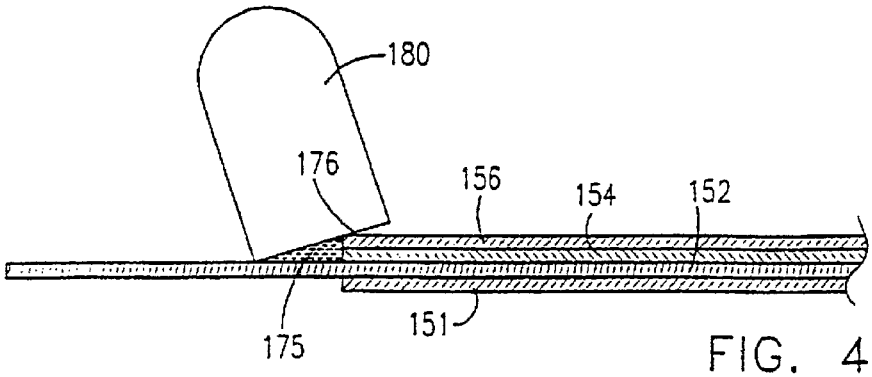

Reference is now made to FIGS. 4A–4C which schematically illustrate a preferred method of applying layer 175 to edge 170, by metered brushing. It should be appreciated that the same application method can be used for applying layer 175 to edge 172 if sheet 12 is constructed as in FIG. 2E. Although the method of FIGS. 4A–4C has been found effective, it should be appreciated that other application methods, such as spraying or dipping, may also be suitable.

FIG. 4A illustrates a first step in the metered application method, in which a series of drops 178 of the insulating material are guided along the surface of an application blade 177 to a portion of backing layer 152 close to edge 170 of layer 154. Drops 178 are preferably separated from edge 170 by a gap of approximately 3–4 millimeters. The series of drops formed on layer 152 in parallel with edge 170 is shown in FIG. 4B. Sheet 12 is preferably positioned on a detachable base layer, formed of paper or the like, which extends beyond sheet 12 at least at the portion indicated by reference numeral 179. This enables application of at least one drop of insulating material outside the borders of sheet 12, allowing complete coverage of edge 170 by the brushing technique described below.

FIG. 4C illustrates a preferred brushing technique, wherein a smooth and straight edge of a brushing sheet 180, preferably formed of a resilient material, is urged against sheet 12 and moved in a brushing motion along edge 170. Brushing sheet 180 may be formed of any suitable rubber or plastic material having a suitable resilience and surface smoothness. In one preferred embodiment of the invention, brushing sheet 180 is formed of the material used for the intermediate transfer blanket described in U.S. patent application Ser. No. 08/371117, now U.S. Pat. No. 5,745,829 the disclosure of which is incorporated herein by reference. In the configuration of drops 178 shown in FIG. 4B, the brushing action is from bottom to top, starting from region 179 outside sheet 12.

To ensure complete coverage of edge 170, the total amount of insulating material in drops 178 is equal to at least the volume enclosed by the trailing edges of layers 154 and 156, protruding layer 152 and the brushing plane defined by the action of brushing sheet 180. The resilience of the edge of brushing sheet 180 ensures gap-free application of insulating layer 175 to edge 170 and maintains the thickness of extension 176 of layer 175 at a minimum.

In one aspect of the present invention the paper layer of WO 96/07955 is omitted and the drum is coated with a preferably closed pore sponge layer, preferably having a Shore A hardness of about 30–70, more preferably about 50–70 and most preferably about 60.

Between the sponge layer and the backing layer, a layer of hydrocarbon liquid is applied, which liquid acts as a dust masking layer to keep dust from infiltrating behind the backing sheet.

While an open weave paper layer as described in WO 96/07955 does avoid the infiltration of dust particles underneath the backing layer, it is only partially successful in dealing with the deleterious effects of dust particles already situated on the back of the sheet before it is applied on the drum. In fact, while without the paper sheet the dust particles are found to "travel" under the backing layer, resulting in streak-like defects in the images caused by like-shaped defects in the photoreceptor, with the paper layer, the defects which are produced are point defects having a star like shape. These defects are caused by the deformation of the surface of the photoreceptor caused by the underlying dust particle. It has been found that quite small dust particles can cause defects which are many times their size in the final image. Of course, to the extent that the dust particle is buried in the underlayer, its effect is reduced; however, because of the nature of the structure of paper, star effects still exist to a certain extent.

Figure 5:
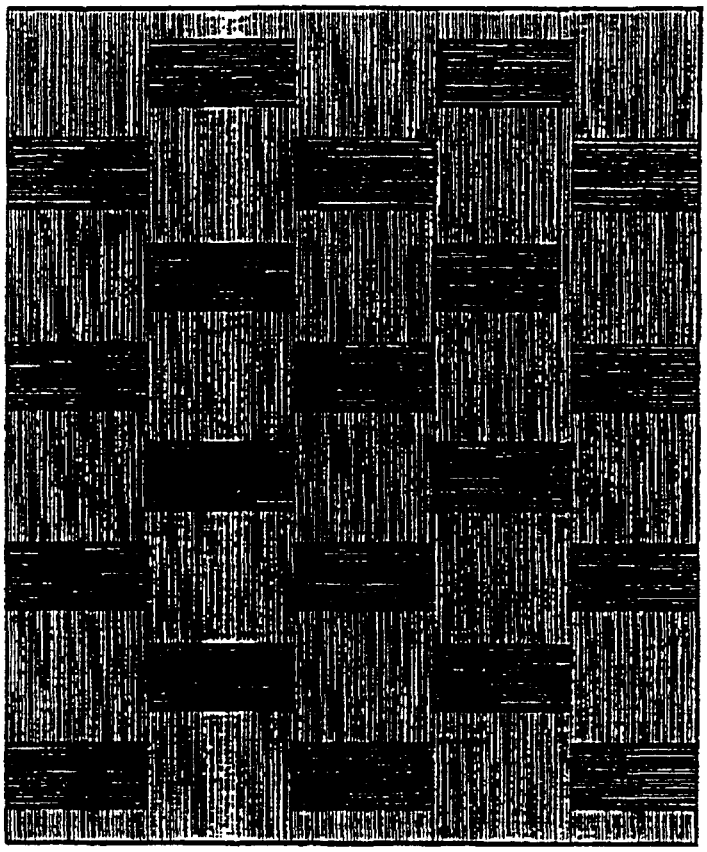
FIG. 5 is a top view of an underblanket dust masking layer in accordance with a preferred embodiment of the invention.

In a preferred embodiment of the invention, the paper layer of WO 96/07955 is replaced by a cloth sheet, preferably of an open weave cloth, such as that shown in FIG. 5. Preferably the cloth is coated with or attached to a rubber layer having a Shore A hardness of 20–40, preferably about 30, which rubber layer is placed against the drum, with the cloth weave being placed against the back of the photoreceptor.

In a preferred embodiment of the invention, the cloth sheet is bonded to the drum and the photoreceptor is laid above and in contact with the weave. Alternatively, the cloth sheet may be bonded to the photoreceptor as described above for the paper sheet.

The advantages of a cloth sheet and especially a cloth sheet reinforced with a rubber backing layer, are the absence of star marks when a layer as described below is used and the increased resistance to deterioration of the cloth sheet as compared to the paper layer. Furthermore, the cloth layer, when adhered to the drum, results in easier installation of replacement photoreceptors and no deleterious effects from wrinkled paper underliners.

The operational advantages are the result of the increased compressibility of the cloth as compared to paper and the improved "capture" of dust particles by the cloth as compared to the paper.

Figure 6:
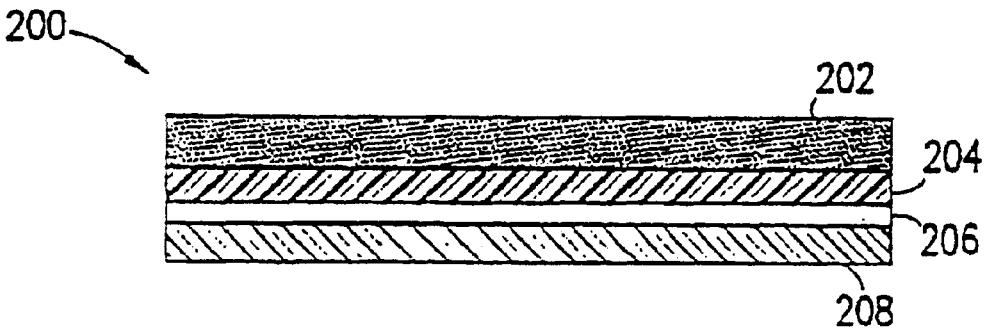
FIG. 6 is a schematic sectional side view of the underblanket of FIG. 5.

A preferred embodiment of a cloth underlying sheet 200 is shown in FIGS. 5 and 6. In FIG. 5, the structure of the weave is shown. FIG. 6 shows a cross-section of the sheet including preferably three layers, a cloth layer 202, a rubber layer 204 which underlies but does not fill the weave and an adhesive layer 206 used for attachment to the drum. A protective layer 208 is placed on the rubber layer for protection. The protective layer is removed before attachment of sheet 200 to the drum.

In a preferred embodiment of the invention, layer 202 is a layer of polyester. The weave is made up of woven groups of yarn, preferably of about 10 micrometers diameter.

In one direction the cloth is closely woven with an extent of 300–320 micrometers per warp repeat with the yarn filling 90%–100% of the space (approximately 42 fibers per warp repeat). In the other direction, the weave is looser, with a repeat of 230–260 micrometers with the yarn filling about 55% to 70% of the space (approximately 30 fibers per repeat). Preferably the fabric is about 100 micrometers thick. This cloth has an increased compressibility and dust masking ability as compared to paper. The preferred material has a weight of 50±2 grams/m$^2$ according to ASTM D 3776-86. The yarn is 48 Den in the warp and 77.6 Den in the other direction, according to ASTM-D 1059-87. Each yarn is made up of a number of fibers having 2%–4% of the diameter of the final yarn. Such material is available under the trade name Havex Textile 7704 from HAVEX, Hamburg, Germany.

Alternatively, nylon yarn can be used. It should be understood that other materials (or the same materials) with varying construction details can be used, so long as the material has the requisite resilience and dust masking ability.

Rubber layer 204 is preferably of an acrylic rubber material and is preferably about 45–50 micrometers thick and has a Shore A hardness of about 20–30. The adhesive layer is generally about 2–3 micrometers thick.

The particular materials indicated above for underlying sheet 200 have been chosen to be compatible with the liquid toner printing process (i.e., to be immune for attack by the hydrocarbon liquids used in the process) and to give compressibility and dust trapping capability compatible with the printing process in which they are used. It should be clear that a larger or more open weave may result in a mottling effect and a lack of resiliency. On the other hand, a tighter weave may result in a reduction in dust trapping efficiency or a reduction in the compressibility of the fabric. The structure of the fabric is chosen within these guidelines. The rubber layer is made thin and soft. Its basic task is to protect the adhesive layer against the carrier liquids used in the liquid toners with which the photoreceptor is used and to add additional resilience to the total structure. With these guidelines in mind, other rubber materials such as Fluorosilicone rubber or Polyurethane can also be used.

It is recommended that the composite fabric material be cut with a laser cutter to eliminate small fibers at the edges of the fabric.

If the back of the rubber layer is very smooth, the adhesive layer may be omitted and the smooth layer will cling to the smooth surface of the drum.

It will be appreciated by persons skilled in the art that the present invention is not limited by the description and example provided hereinabove. Rather, the scope of this invention is defined only by the claims which follow:

What is claimed is:

1. A photoreceptor for mounting on a drum comprising:

a photoreceptor sheet comprising a backing layer, a conductive layer and a photoconductive layer; and an underlayer comprising a layer of cloth.

2. A photoreceptor system according to claim 1 wherein the layer of cloth is a layer of open weave cloth.

3. A photoreceptor system according to claim 1 and including an adhesive layer on the side of the underlayer opposite the cloth layer.

4. A photoreceptor system according to claim 2 and including an adhesive layer on the side of the underlayer opposite the cloth layer.

5. A photoreceptor according to any of claims 1–4 and comprising a resilient layer attached to the cloth layer.

6. A photoreceptor according to claim 5 wherein the resilient layer is a rubber layer.

7. A photoreceptor system according to claim 5 wherein the resilient layer has a Shore A hardness of between 20 and 30.

8. A photoreceptor system according to claim 5 wherein the resilient layer does not fill the weave in the cloth.

9. A photoreceptor system according to any of claims 1–4 wherein the cloth layer comprises a polyester material.

10. A photoreceptor system according to any of claims 1–4 wherein the cloth layer comprises a nylon material.

11. A photoreceptor system according to claim 1 or claim 3, wherein the cloth is woven and wherein the cloth is formed of thin threads of material taken in groups to produce the weave.

12. A photoreceptor system according to claim 11 wherein the cloth has a warp repeat and wherein the threads have a diameter of less than about 5% of the warp repeat of the cloth.

13. A photoreceptor according to claim 11 wherein the cloth has a warp repeat and wherein the repeat of the weave of the cloth is between about 230 micrometers and about 320 micrometers in at least one direction.

14. A photoreceptor according to claim 1 or claim 3 wherein the cloth is woven and wherein threads used to form the weave fill less than about 70% of its weave in at least one direction.

15. A photoreceptor system according to claim 2 or claim 4, wherein the cloth is formed of thin threads of material taken in groups to produce the weave.

16. A photoreceptor system according to claim 15 wherein the cloth has a warp repeat and wherein the threads have a diameter of less than about 5% of the warp repeat of the cloth.

17. A photoreceptor according to claim 15 wherein the cloth has a warp repeat and wherein the repeat of the weave of the cloth is between about 230 micrometers and about 320 micrometers in at least one direction.

18. A photoreceptor according to claim 2 or claim 4 wherein the cloth is woven and wherein threads used to form the weave fill less than about 70% of its weave in at least one direction.

19. A photoreceptor system for mounting on a drum comprising:

a photoreceptor sheet comprising a backing layer, a conductive layer and a photoconductive layer; and an underlayer comprising a layer of sponge material.

20. A method for attaching a photoreceptor system to a drum comprising:

providing a photoreceptor system according to any of claims 1–4 or 19; and attaching the photoreceptor system to the drum with the underlayer between the photoreceptor and the drum.

21. A method according to claim 20 wherein the underlayer is adhered to the drum.

22. A method of preparing a drum for placement of a photoreceptor according to any of claims 1–4 thereon comprising:

providing a drum; and bonding the cloth underlayer of the photoreceptor to the drum.

23. A method of preparing a drum for placement of a photoreceptor according to claim 19 thereon, comprising:

providing a drum; and bonding the sponge underlayer of the photoreceptor to the drum.

24. A method for attaching a photoreceptor system to a drum comprising:

preparing a drum according to claim 22; and placing the photoreceptor sheet on the underlayer.

25. A method for attaching a photoreceptor system to a drum comprising:

preparing a drum according to claim 23; and placing the photoreceptor sheet on the underlayer.

26. Imaging apparatus comprising:

a drum adapted for mounting a photoreceptor thereon; and a photoreceptor according to claim 19 mounted on the derum.

27. Imaging apparatus comprising:

a drum adapted for mounting a photoreceptor thereon; and a photoreceptor according to any of claims 1–4 mounted thereon.

28. Imaging apparatus adapted for the mounting of a photoreceptor comprising:

a drum adapted for receiving a photoreceptor sheet, wherein the drum is prepared in accordance with claim 22.

29. Imaging apparatus adapted for the mounting of a photoreceptor comprising:

a drum adapted for receiving a photoreceptor sheet, wherein the drum is prepared in accordance with claim 23.

30. A photoreceptor according to any of claims 1–4 or 19 wherein the photoreceptor sheet has a substantially rectangular shape.

31. A photoreceptor according to any of claims 1–4 wherein the cloth is a woven cloth.

* * * * *